US005743055A

United States Patent [19]

Conner et al.

[11] Patent Number: 5,743,055

[45] Date of Patent: Apr. 28, 1998

[54] WALL PANEL CONNECTOR SYSTEM

[75] Inventors: John P. Conner, Grandville, Mich.; Sandra Lee From, Issaquah, Wash.

[73] Assignee: Hon Industries Inc., Muscatine, Iowa

[21] Appl. No.: 664,098

[22] Filed: Jun. 4, 1996

[51] Int. Cl.[6] ..... E04B 1/38

[52] U.S. Cl. ..... 52/282.2; 52/282.4; 52/282.5; 52/584.1; 160/135

[58] Field of Search ..... 52/282.2, 282.4, 52/282.5, 284, 584.1, 586.1; 160/135

[56] References Cited

U.S. PATENT DOCUMENTS

| | | | |
|---|---|---|---|
| Re. 27,215 | 11/1971 | Propst et al. . | |
| 3,312,025 | 4/1967 | Deakins . | |
| 3,605,851 | 9/1971 | Miles et al. . | |
| 3,768,222 | 10/1973 | Birum, Jr. . | |
| 3,777,434 | 12/1973 | Selden et al. . | |
| 3,877,191 | 4/1975 | Munsey . | |
| 3,987,838 | 10/1976 | LaGue et al. . | |
| 4,047,342 | 9/1977 | Boulva . | |
| 4,104,838 | 8/1978 | Hage et al. . | |
| 4,129,163 | 12/1978 | Johnson . | |
| 4,192,106 | 3/1980 | Hell . | |
| 4,232,183 | 11/1980 | Person . | |
| 4,334,374 | 6/1982 | Spamer et al. . | |
| 4,430,838 | 2/1984 | Bains . | |
| 4,438,614 | 3/1984 | Raith et al. . | |
| 4,571,907 | 2/1986 | DeFouw et al. . | |
| 4,601,146 | 7/1986 | Harter et al. . | |
| 4,638,614 | 1/1987 | Wilcox | 160/135 X |
| 4,821,788 | 4/1989 | Nelson . | |
| 4,825,930 | 5/1989 | Lindberg et al. | 160/135 |
| 4,860,812 | 8/1989 | DePietro et al. . | |
| 5,058,347 | 10/1991 | Schuelke et al. . | |
| 5,088,250 | 2/1992 | DeLong et al. . | |
| 5,088,541 | 2/1992 | Persing et al. . | |
| 5,097,643 | 3/1992 | Wittler . | |
| 5,101,606 | 4/1992 | Meru . | |
| 5,117,599 | 6/1992 | Voss . | |
| 5,142,997 | 9/1992 | DeLong et al. . | |
| 5,238,515 | 8/1993 | Insalaco et al. . | |
| 5,363,616 | 11/1994 | Hernandez | 52/282.2 X |
| 5,377,466 | 1/1995 | Insalaco et al. . | |

*Primary Examiner*—Carl D. Friedman
*Assistant Examiner*—Timothy B. Kang
*Attorney, Agent, or Firm*—Jones, Day, Reavis & Pogue

[57] ABSTRACT

A system for connecting wall panels in abutting edgewise relation, wherein abutting edges of the panels are formed with semi-circular recesses in them, includes pairs of spaced slots formed in the corners defining transverse semi-circular edges of the panel frames. Two connectors are provided having conical recesses for engaging the edges of the slots. The connectors are each fastened by a screw to an end of an elongate bar which fits within the recesses of the corners. When the connectors are fastened tightly to the bar, the engagement of the conical recesses with the corner edges draws the panels tightly together. By this system, the panels may be connected either in-line or at an angle of between 90 and 180 degrees, without the need for any special corner hardware.

14 Claims, 4 Drawing Sheets

WALL PANEL CONNECTOR SYSTEM

BACKGROUND OF THE INVENTION

1. Field of the Invention

The present invention relates generally to a system for connecting wall panels of a type used in open-plan office environments and, more particularly, to a panel connector system which is easy to install and allows for alternative panel configurations which are highly sturdy when assembled.

2. Description of the Prior Art

Open-plan office systems have gained wide acceptance in the construction of modern office space. These systems comprise modular panel assemblies connected in configurations which divide or partition the work space into office cubicles suitable for varieties of specific tasks. The panels are often constructed with a steel framework having a lightweight core of fiberglass or fiberboard and covered by a decorative fabric meant to compliment the decor of the office. The panels may be designed to support cabinets, shelves, desk surfaces and the like. Hence, they must be assembled in a manner as to be relatively rigid and sturdy.

Many systems are known for connecting modular wall panels in edgewise relation. Typically, these systems are intended to permit ease of panel assembly with limited need for tools or other installation equipment so that panels can be set up quickly and without significant disruption of the office environment. Connection systems necessarily must provide for rigid assembly of the panels but must also be conveniently installed in the event that reconfiguration or dismantling of the panel arrangement is desired. An example of a known connector system is disclosed in U.S. Pat. No. 4,571,907 issued to DeFouw et al. In that system, the edge frames of adjoining panels are provided with channels which receive an elongate tube. A wedge system is used at the top of the tube to draw the panels together as a screw is tightened. Tightening of the screw also draws the tube upwardly such that lower clips engage the bottoms of panel frames and hold the panel bottoms together.

While the system as just described provides for convenient and sturdy edgewise connection of panels, it has the limitation that panels may only be connected in a straight line unless separate corner devices are used to allow for angular panel connection. These corner devices not only add to the cost of the panel system, they add inconvenience in panel set-up. Accordingly, it is desirable to provide a modular wall panel connector system which is capable of connecting panels very rigidly but with few separate parts. It is further desirable to provide such a connector system which is convenient to install. Still further, it is desirable to provide such a connector system which permits both in-line and angular assembly of wall panels without the need for additional and specially made parts.

SUMMARY OF THE INVENTION

The present invention improves over the prior art by providing a system for connecting wall panels wherein abutting edges of the panels have corners formed with semi-circular recesses in them. Pairs of spaced slots are formed in the corners defining transverse semi-circular edges of the panel frames. Two connectors are provided having conical recesses for engaging the edges of the slots. The connectors are each fastened by a screw to an end of an elongate bar which fits within the recesses of the corners. When the connectors are fastened tightly to the bar, the engagement of the conical recesses with the corner-edges draws the panels tightly together. By this system, the panels may be connected either in-line or at an angle of between 90 and 180 degrees without the need for any special corner hardware.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
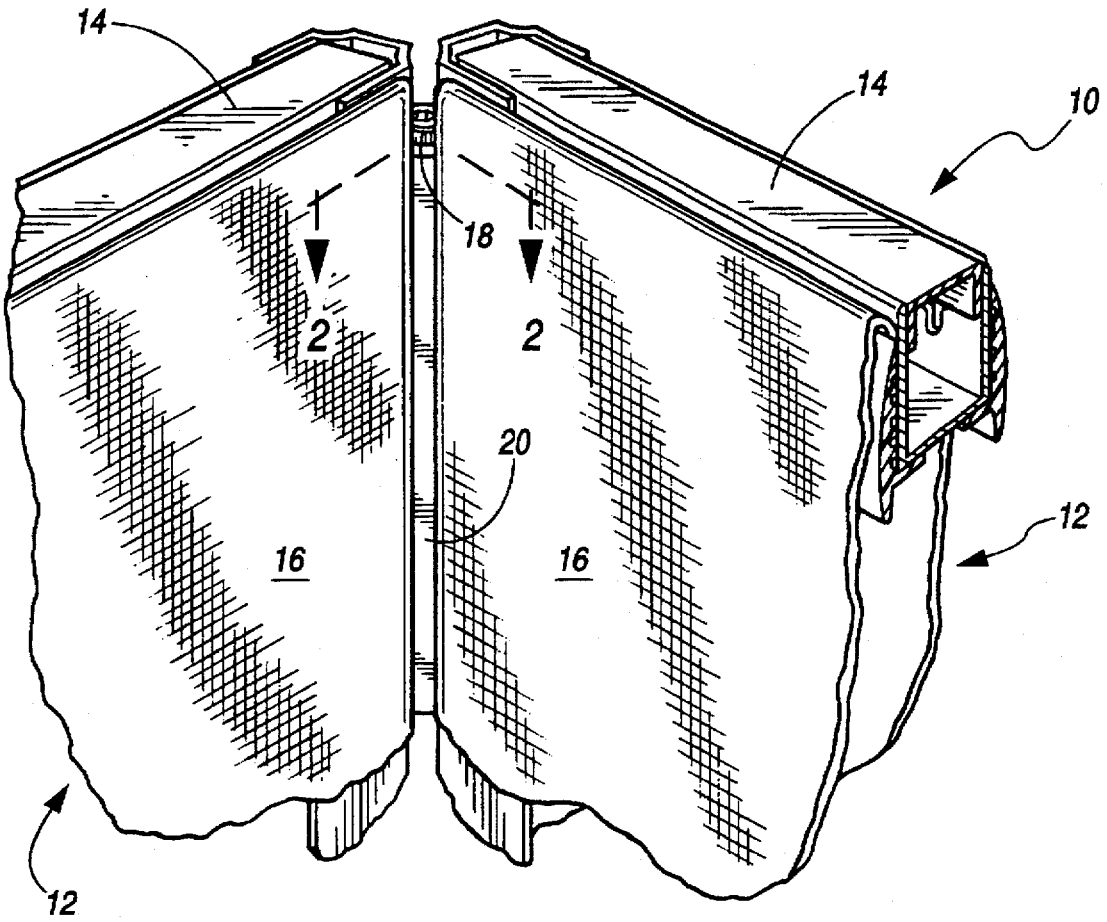
FIG. 1 is a partial perspective view of a modular wall panel assembly constructed in accordance with the principles of the invention showing wall panels connected in angular relation.
Figure 2:
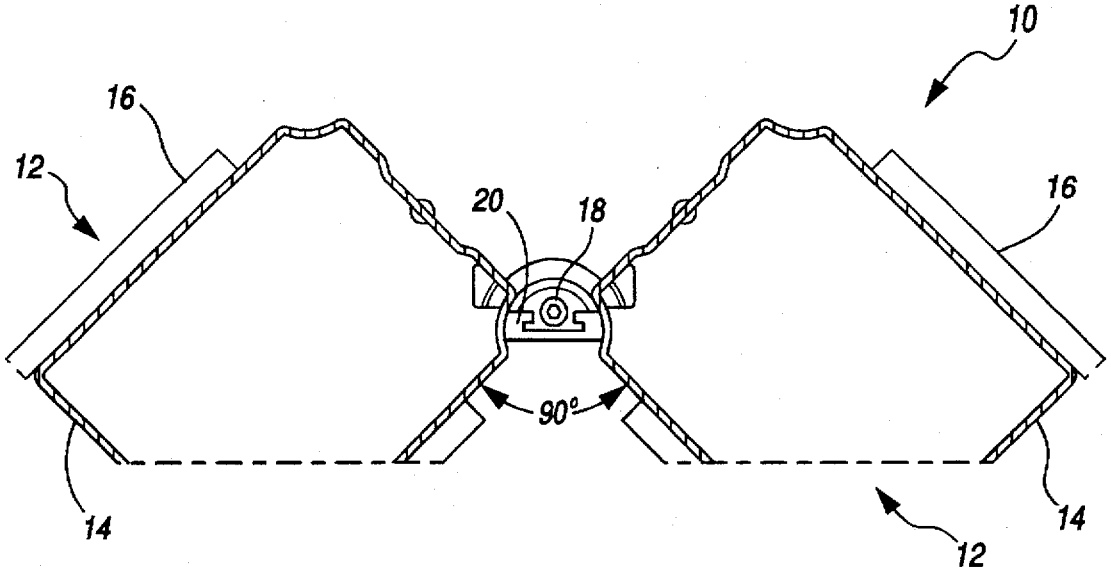
FIG. 2 is a cross-sectional view taken substantially along he lines 2—2 of FIG. 1.
Figure 3:
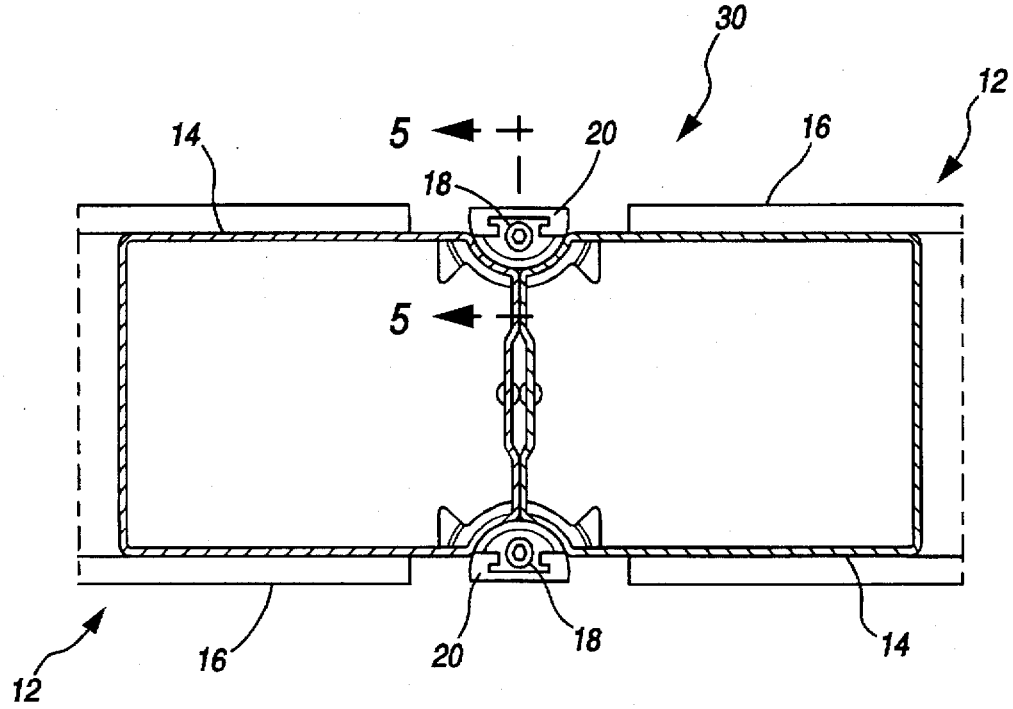
FIG. 3 is a cross-sectional view of two wall panels connected according to the invention in in-line relation.

Referring now to the drawings, and initially to FIGS. 1 and 2, a system of connected wall panels is designated generally by the reference numeral 10. The system 10 comprises wall panels 12 which, in a manner well-known in the art, are constructed of steel frames 14 surrounding suitable panel cores (not shown) and covered by decorative fabric 16. The illustrated panels 12 are connected in angular relation by a pair of vertically spaced connector members 18 (only one of which can be seen) fastened to opposite ends of a mast or bar 20 in a manner which will be described in detail hereinafter. FIG. 3 illustrates a panel system 30 in which panels 12 are connected in an in-line configuration by two sets of connector members 18 and associated bars 20.

Figure 4:
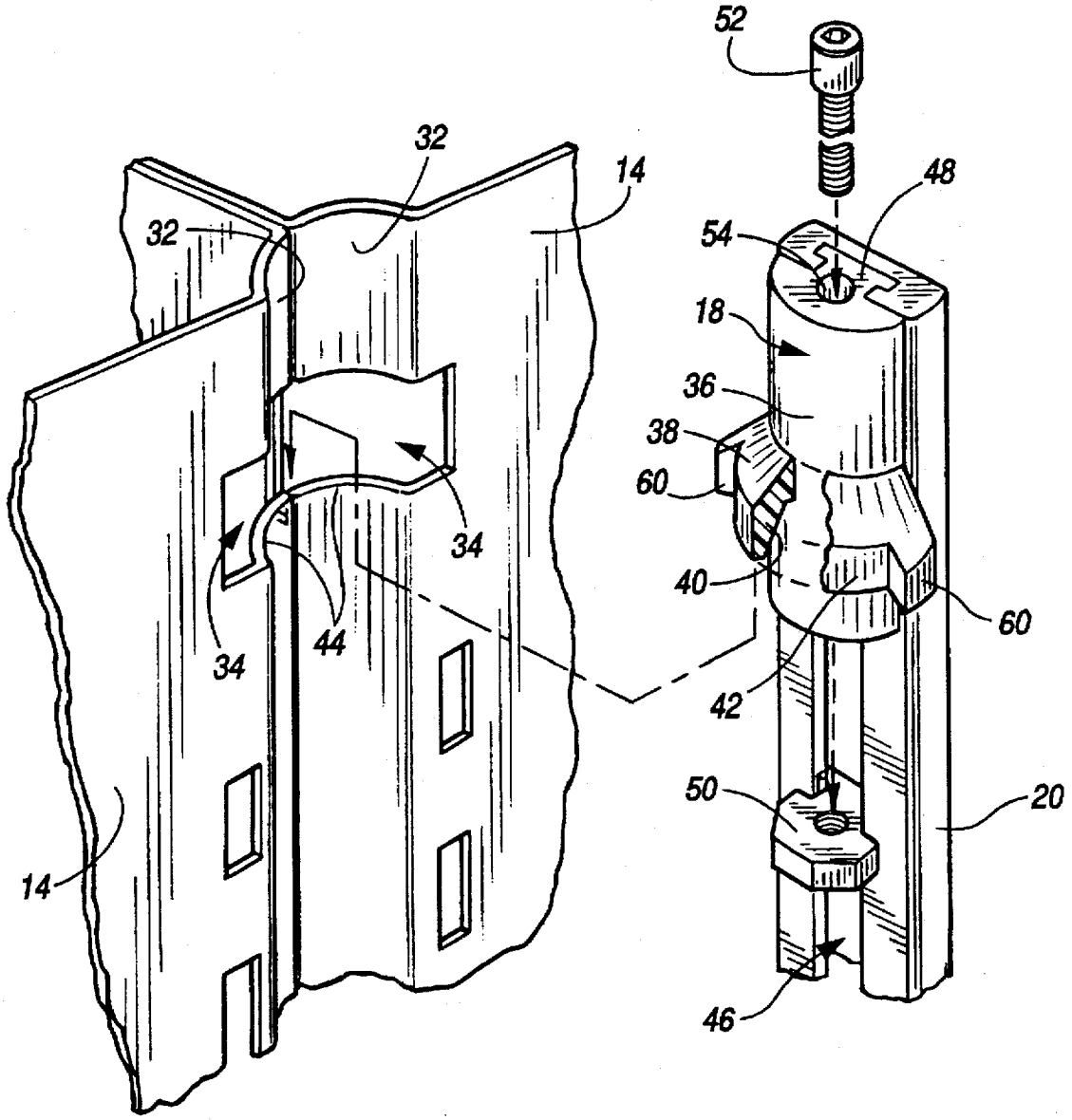
FIG. 4 is a partial exploded perspective view of the panel connector system of the invention.
Figure 5:
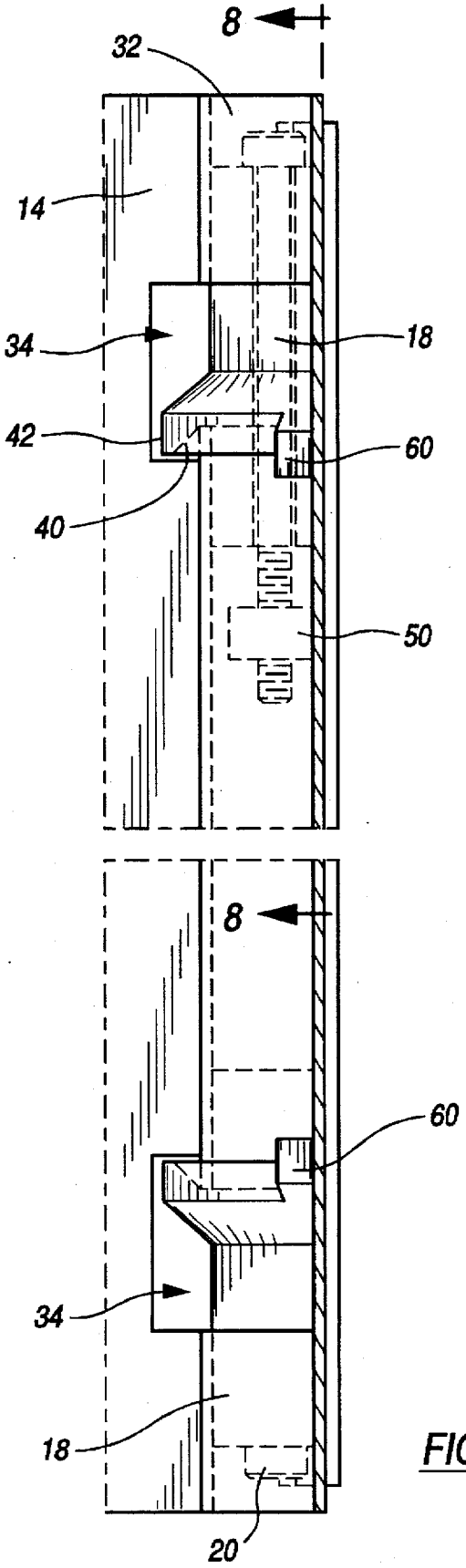
FIG. 5 is a fragmentary cross-sectional view of the connector system as installed.

Details of the connector system can be seen with reference to FIGS. 4 and 5. In accordance with the invention, vertical corners of the panel frames 14 are formed with longitudinal semi-circular recesses 32. Near the top and bottom of each panel, the recesses 32 are provided with slots 34. The connector members 18 are formed with a semi-circular portion 36 dimensioned to be received in the recesses 32 of two edgewise abutting panels 12. A head portion 38 of each connector member 18 extends through the slots 34 of the adjacent panels 12. Interior to the head portion 38 is a conical recess 40 defining a semi-annular lip 42. The lip 42 and associated recess 40 are dimensioned to cooperate with semi-circular edge portions 44 of the panel corners 32 defined by the slots 34. The mast or bar 20 is provided with a generally T-shaped groove 46 which slidingly receives a corresponding T-shaped tongue 48 of the connector member 18. Thus, pairs of opposed connector members 18 are adjustable longitudinally of the bar 20. Spaced from the distal ends of the bar 20 are a pair of threaded lugs 50 which receive screws 52 that pass through bores 54 of the connector members 18.

Figure 6:
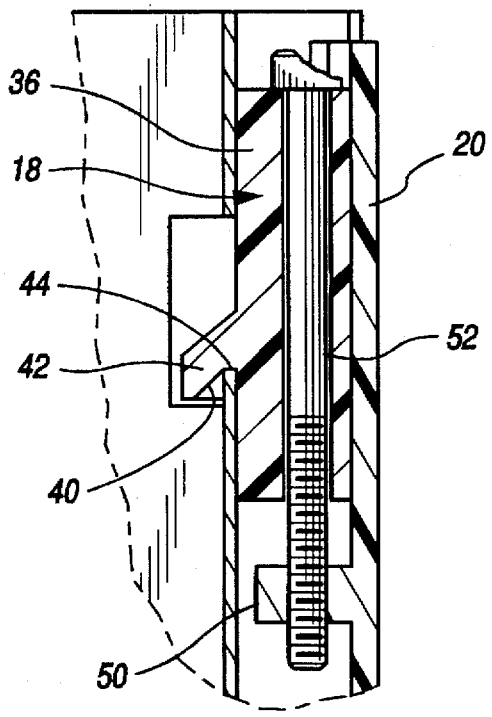
FIG. 6 is another fragmentary cross-sectional view of the connector system as installed;.

It can be seen particularly with reference to FIG. 6 that when the head portions 38 of the connector members 18 are inserted into the slots 34, the lips 42 will extend into the slots and the conical recesses 40 will come into engagement with the slot edges 44. Suitable notches 56 permit the lips 42 to fit behind the corners 14 allowing the edges 44 to ride up the ramped surfaces of the recesses 40, thereby drawing the corners 14 together as one of the screws 52 is tightened into the corresponding lug 50 of the bar 20. The result is that the connectors 18 firmly secure the tops and bottoms of the panels 12 together.

It can now be appreciated that the connector system in accordance with the invention provides for highly rigid but convenient connection of panels 12. When it is desired to connect panels in an in-line configuration, as shown in FIG. 3, two pairs of connectors 18 and associated bars 20 may be fastened to both sides of the panel 12 creating a very sturdy joint. If an angular configuration of panels 12 is desired, the panels 12 may be rotated relative to one another about a pivot axis coincident with the longitudinal axis of one bar 20, as seen in FIG. 2, with the pair of connectors 18 loosely installed. Then, the connectors 18 may be tightened after the panels 12 have been positioned at the desired angle. Wings 60 may be formed on the head portions 38 of the connectors 18 and so configured to abut interior walls of the panel frames 14 to limit relative angular movement of the panels 12 to a minimum of ninety degrees.

Although the invention has been described in connection with preferred embodiments thereof, it will be apparent to those skilled in the art that many changes and modifications may be made without departing from the true spirit and scope of the invention. Accordingly, it is intended by the appended claims to cover all such changes and modifications as come within the spirit and scope of the invention.

What is claimed is:

1. A system for connecting panels in edgewise relation comprising:

a pair of panels each having a frame member disposed along an edge thereof, the frame members having lengthwise corners, at least one corner of each panel being formed with a semi-circular cross-section recessed inwardly of said frame member;

a slot formed in the said one corner of each panel, the slot defining transverse semi-circular edges of said corner;

a first connector for connecting two adjacent panels together, said first connector having an internal recess and configured with a tapering conical wall, said first connector further having a through bore for receiving a mechanical fastener;

an elongate mast having first and second ends, a first end being connected to both of said frame members by a second connector and a second end being connected to said first connector by a mechanical fastener extending through said connector, said first connector being slidingly received on said mast;

wherein said mechanical fastener draws said conical wall of said first connector into engagement with said semi-circular edges of said panel slots thereby forcing said two adjacent panels together.

2. The system of claim 1 wherein said mechanical fastener is a machine screw and said screw is threadedly received by said mast.

3. The system of claim 1 wherein said second connector is identical to said first connector.

4. The system of claim 1 wherein said panels are rotatable with respect to one another about an axis coincident with the longitudinal axis of said mast.

5. The system of claim 4 wherein said first connector is provided with a pair of laterally extending wing portions and said wing portions engage corresponding walls of said frame members to limit relative rotational movement of said panels about said axis.

6. The system of claim 5 wherein said wing portions are configured to limit said relative rotational movement to a maximum angle of ninety degrees.

7. The system of claim 1 wherein sliding attachment of said connector and mast is provided by a dovetail joint.

8. A system for connecting modular panels in edgewise relation comprising:

a pair of panels each having a vertically oriented frame member along an edge thereof, the frame members having corners, at least one corner of each panel frame member being formed with a semi-circular cross-sectional portion recessed inwardly of said frame member;

a first pair of slots formed in each said one corner defining transverse semi-circular edges of said corners, said slots being aligned with one another when said panels are positioned adjacent one another in edgewise relation;

a second pair of slots formed in each said one corner defining transverse semi-circular edges of said corners, said second pair of slots being spaced along said first pair of slots and being aligned with one another when said panels are positioned adjacent one another in edgewise relation;

a pair of connectors each being receivable within one of said pairs of slots and having means for engaging said semi-circular edges of said corners;

an elongate mast having first and second ends, said ends having means for connection of a connector thereto;

wherein said mast and connector cooperate to retain said panels in abutting connected relationship.

9. The system of claim 8 wherein at least one of said connectors is slidingly received by said mast.

10. The system of claim 8 wherein said connectors are provided with conical recesses and said recesses engage said semi-circular edges of said corners.

11. The system of claim 8 wherein said connectors are fastened to said mast by screws.

12. The system of claim 8 wherein said panels are rotatable with respect to one another about an axis coincident with the longitudinal axis of said mast.

13. The system of claim 12 wherein said connectors are provided with pairs of laterally extending wing portions and said wing portions engage corresponding walls of said frame members to limit relative rotational movement of said panels about said axis.

14. The system of claim 13 wherein said wing portions are configured to limit said relative rotational movement to a maximum angle of ninety degrees.

* * * * *

UNITED STATES PATENT AND TRADEMARK OFFICE

CERTIFICATE OF CORRECTION

PATENT NO. : 5,743,055
DATED : April 28, 1998
INVENTOR(S) : John P. Conner et al.

It is certified that error appears in the above-identified patent and that said Letters Patent is hereby corrected as shown below:

Column 2,
Line 18, delete "he".

Signed and Sealed this

Fourth Day of June, 2002

*Attest:*

*Attesting Officer*

JAMES E. ROGAN
*Director of the United States Patent and Trademark Office*